US006241548B1

(12) United States Patent
Kuo

(10) Patent No.: US 6,241,548 B1
(45) Date of Patent: Jun. 5, 2001

(54) DEVICE FOR LOCKING TWO MATING CONNECTORS

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/467,088

(22) Filed: Dec. 10, 1999

(30) Foreign Application Priority Data

Nov. 19, 1999 (TW) ..... 88219731

(51) Int. Cl.[7] ..... H01R 13/621
(52) U.S. Cl. ..... 439/358; 439/362
(58) Field of Search ..... 439/362, 358, 439/357

(56) References Cited

U.S. PATENT DOCUMENTS 5,197,900 * 3/1993 Ellis et al. ..... 439/362
5,741,150 * 4/1998 Stinson et al. ..... 439/358
5,775,931 * 7/1998 Jones ..... 439/358
5,860,826 * 1/1999 Chang ..... 439/358
5,941,726 * 8/1999 Koegel et al. ..... 439/358

* cited by examiner

*Primary Examiner*—Gary F. Paumen
(74) *Attorney, Agent, or Firm*—Wei Te Chung

(57) ABSTRACT

A locking device for joining first and second mating connectors together includes a pair of first locking members movably received in the first connector and a pair of second locking members retained in the second connector corresponding to the pair of first locking members. Each first locking member includes a bolt having a threaded portion and a latch rotatably positioned beside the bolt. The latch defines an opening in a head thereof and forms at least one spring arm by which the latch is biased to engage the second locking member. Each second locking member includes a retention portion, an expanded portion opposing the retention portion and a recessed portion between the retention portion and the expanded portion. The expanded portion defines an inner-threaded hole. When the first connector is mated to the second connector, the openings of the latches accommodate the expanded portions of the second locking member and the threaded portions of the bolts are threadably received in the inner-threaded holes of the second locking members, thereby securely engaging the first locking members and the second locking members together.

2 Claims, 5 Drawing Sheets

DEVICE FOR LOCKING TWO MATING CONNECTORS

BACKGROUND OF THE INVENTION

1. Field of the Invention

The present invention relates to a locking device for joining first and second mating connectors together.

2. Description of the Prior Art

Electrical connection between two mating connectors is often adversely effected by vibration or an unexpected external force. In order to protect the connection from such disturbances, the mating connectors often have engageable locking devices for securely joining the two connectors together. Examples of locking devices are disclosed in U.S. Pat. No. 5,401,189 and Taiwan Patent Application No. 84201383.

Referring to FIG. 5, a conventional connector comprises a dielectric housing 70, a plurality of conductive contacts 71 received in the housing 70, a shield 72 enclosing a front portion of the housing 70 and a pair of locking members 73 for joining the connector and a mating connector (not shown) together. The housing 70 defines a pair of apertures 74 in opposite sides thereof for securely receiving the corresponding locking members 73. The shield 72 defines a pair of cutouts 78 and a pair of through holes 79 at positions corresponding to the apertures 74 of the housing 70. Each locking member 73 forms a cantilevered arm 76 having a hook 77 at a free end thereof and a cavity 75 corresponding to the cutout 78 and the through hole 79 of the shield 72, respectively. Each locking member 73 is received in the corresponding aperture 74 of the housing 70 with the arm 76 extending through the corresponding cutout 78 of the shield 72. The locking member 73 is attached to the housing 70 and the shield 72 by a fastener, such as a screw (not shown), extending through the cavity 75 and the through hole 79.

Since the locking member 73 is relatively large, the aperture 74 of the housing 70 weakens the integrity of the housing 70. In addition, since the hook 77 only engages with a locking member of the mating connector (not shown) at a predetermined position, any deviation therebetween will hinder proper engagement. Further, disengagement between the two mated connectors is complicated because the locking members 73 are not provided with an accessible disengaging device. Hence, an improved electrical connector is required to overcome the disadvantages of the prior art.

BRIEF SUMMARY OF THE INVENTION

An object of the present invention is to provide a locking device having effective locking means for securely engaging two mating connectors together.

To fulfil the above object, a locking device for joining first and second mating connectors together comprises a pair of first locking members movably received in the first connector and a pair of second locking members retained in the second connector in response to the pair of first locking members. Each first locking member comprises a bolt having a threaded portion and a latch rotatably positioned beside the bolt. The latch defines an opening in a head thereof and forms at least one spring arm by which the latch is biased to engage the second locking member. Each second locking member comprises a retention portion, an expanded portion opposing the retention portion and a recessed portion between the retention portion and the expanded portion. The expanded portion defines an inner-threaded hole. When the first connector is mated to the second connector, the openings of the latches accommodate the expanded portions of the second locking members and the threaded portions of the bolts are threadably received in the inner-threaded holes of the second locking members, thereby securely engaging the first locking members and the second locking members together.

Other objects, advantages and novel features of the invention will become more apparent from the following detailed description of the present embodiment when taken in conjunction with the accompanying drawings.

DETAILED DESCRIPTION OF THE INVENTION

Figure 1:
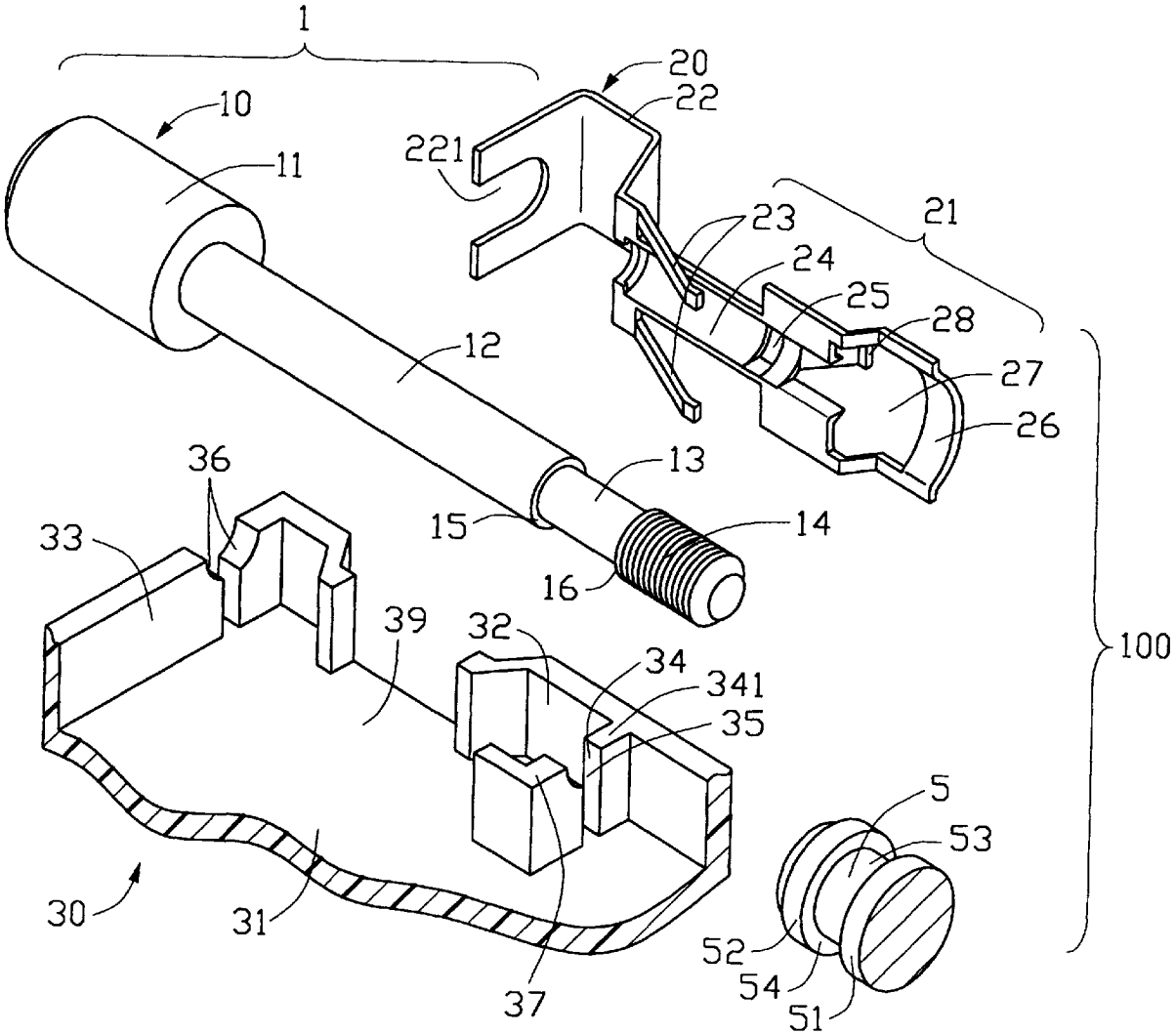
FIG. 1 is an exploded view of a locking means of the present invention and a partial section of a housing of a connector.
Figure 2:
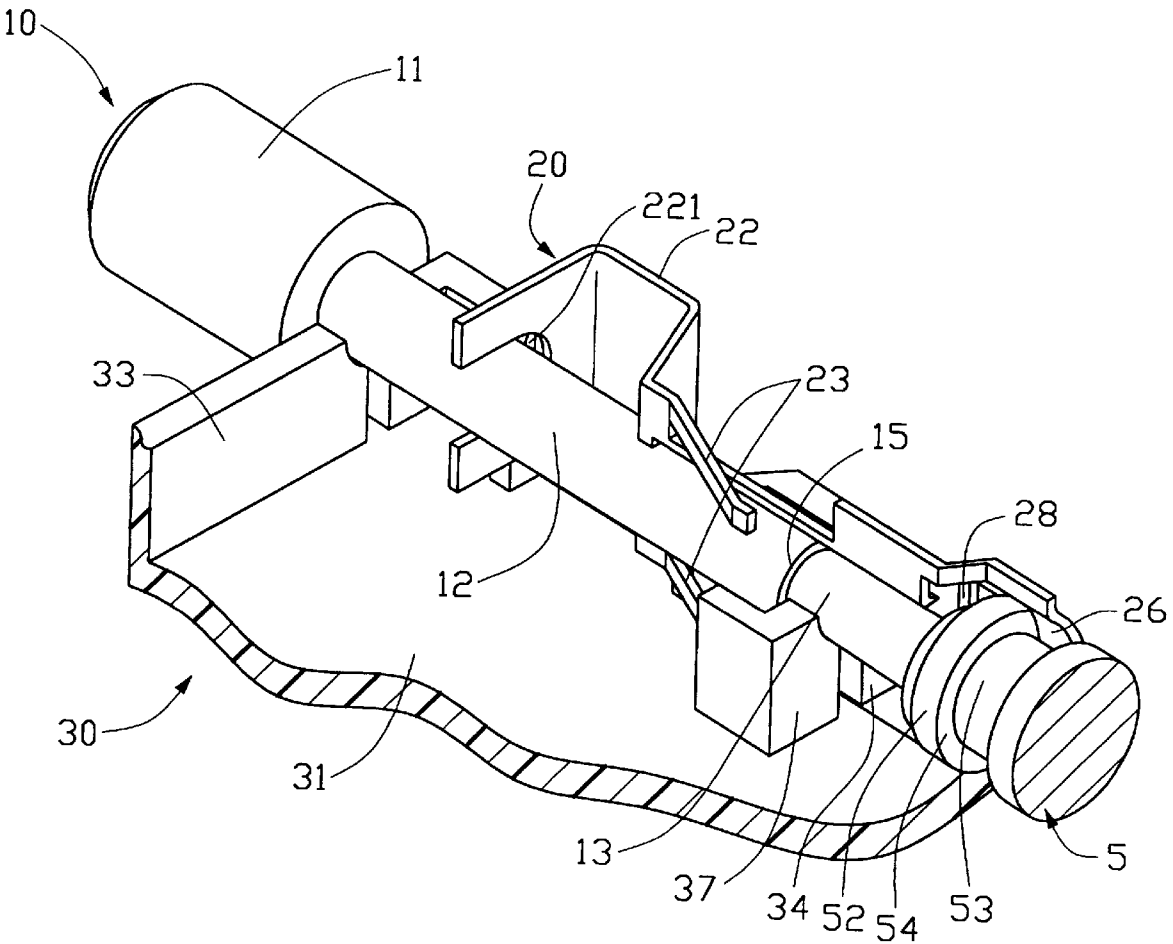
FIG. 2 is an assembled view of FIG. 1.
Figure 3:
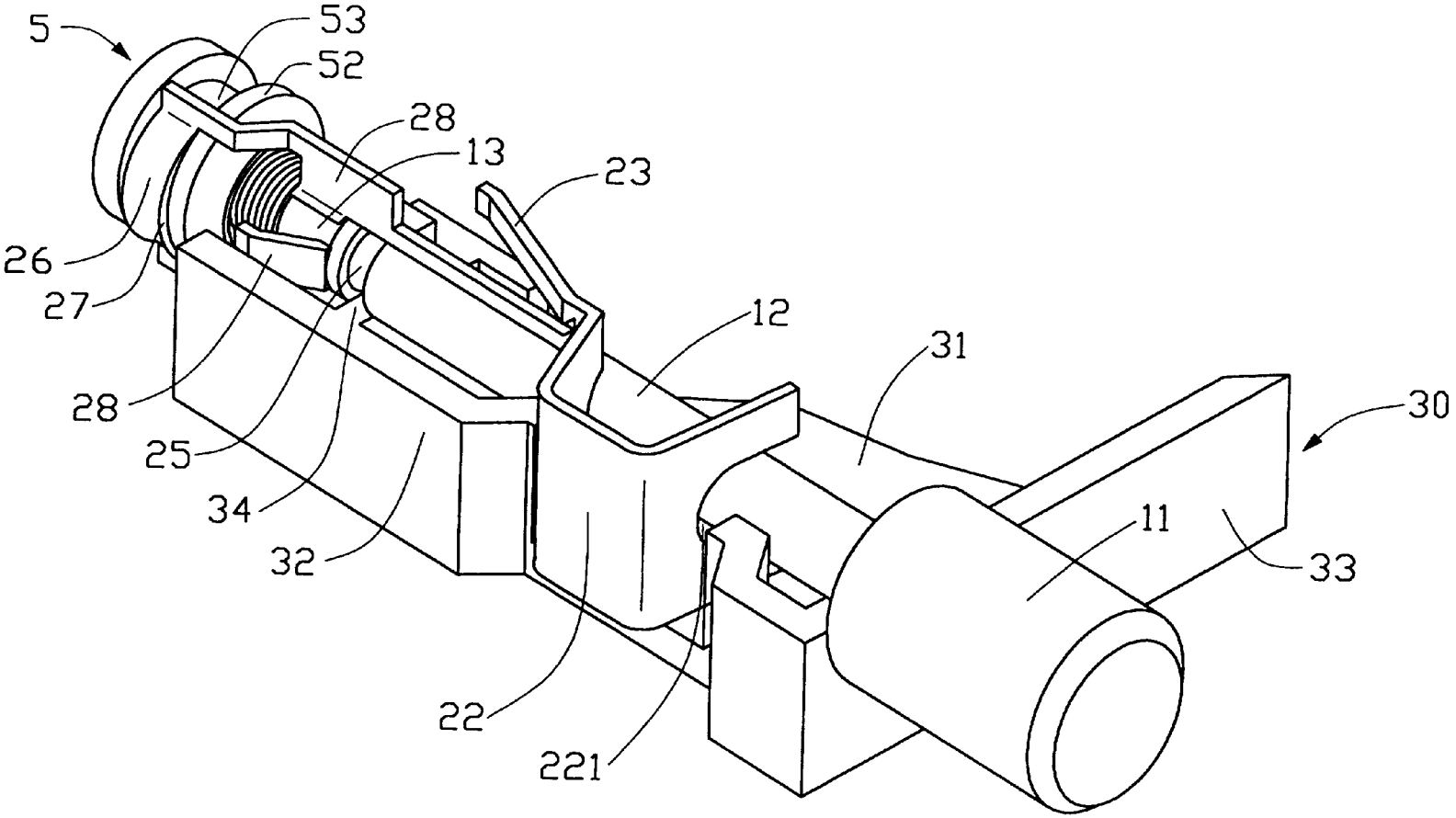
FIG. 3 is similar to FIG. 2 but taken from a different perspective.

Referring to FIGS. 1–3, a locking device for joining a first connector and a second connector comprises a pair of locking means 100 (only one is shown). Each locking means 100 comprises a first locking member 1 movably received in the first connector and a second locking member 5 fixed in the second connector. The first connector comprises an upper housing (not shown), a lower housing 30 (partially shown in FIGS. 1–3) and a plurality of contacts (not shown) received in at least one of the upper and the lower housings. The lower housing 30 comprises a bottom portion 31, a pair of side walls 32 (only one is shown) and a rear wall 33 upwardly extending from the bottom portion 31. Each side wall 32 defines a window 39 adjacent to the rear wall 33 for manually operating the first locking member 1. The rear wall 33 defines a first recess 36. The lower housing 30 further forms a block 34 inwardly extending from each side wall 32 which is spaced a predetermined distance from the rear wall 33. A station 37 is positioned adjacent each block 34 with a second recess 35 defined therebetween. The second connector comprises a second housing and a plurality of second contacts retained in the second housing.

Each first locking member 1 comprises a bolt 10 and a latch 20 rotatably positioned beside the bolt 10. The bolt 10 sequentially comprises an operation portion 11, a pole 12, an intermediate portion 13 and a threaded portion 14. The intermediate portion 13 has a smaller diameter than the pole 12 and the threaded portion 14, thereby two shoulders 15, 16 being formed in opposite ends of the intermediate portion 13. The latch 20 comprises a main portion 21 defining an opening 27 in a head 26 thereof and a press portion 22 for manually rotating the latch 20 relative to the bolt 10. The main portion 21 comprises a pair of first spring arms 23 inwardly extending in an inclined direction and a second spring arm 28 outwardly extending in an inclined direction. The first and second spring arms 23, 28 are offset a predetermined distance from each other along the main portion 21. The main portion 21 forms an arcuate surface 24 in complement with the pole 12 of the bolt 10. The main portion 21 defines a slot 25 in a generally middle portion thereof for purpose described below. The press portion 22 is generally U-shaped and defines a cutout 221 in a free end thereof so that the press portion 22 is allowed to move toward the pole 12 with the pole 12 partially received in the cutout 221.

Each second locking member 5 comprises a retention portion 51 generally retained in the second connector, an expanded portion 52 opposing the retention portion 51 and a recessed portion 53 between the retention portion 51 and the expanded portion 52. The recessed portion 53 has a smaller diameter than the expanded portion 52. The expanded portion 52 defines an inner-threaded hole (not shown) therein for threadably engaging with the threaded portion 14 of the bolt 10 of the first locking member 1.

In assembly, the bolt 10 and the latch 20 are collected together with the arcuate surface 24 of the latch 20 partially accommodating the pole 12. The assembly of the bolt 10 and the latch 20 is then positioned in the housing of the first connector. The pole 12 is rotatably received in the first recess 36 and the intermediate portion 13 is received in the second recess 35 with the shoulders 15, 16 located on opposite sides. The bolt 10 is movable in an elongate direction thereof because the distance between the first and second shoulders 15, 16 is greater than the thickness of the block 34. The press portion 22 of the latch 20 partially exposes out of the housing 30 through the window 39. The slot 25 receives a top corner 341 of the block 34 therein for serving as a pivot point of the latch 20. The first spring arms 23 and the second spring arm 28 resiliently abut against the station 37 and the side wall 32, respectively, whereby the head 26 of the main portion 21 of the latch 20 is biased to move toward the threaded portion 14 of the bolt 10.

Figure 4B:
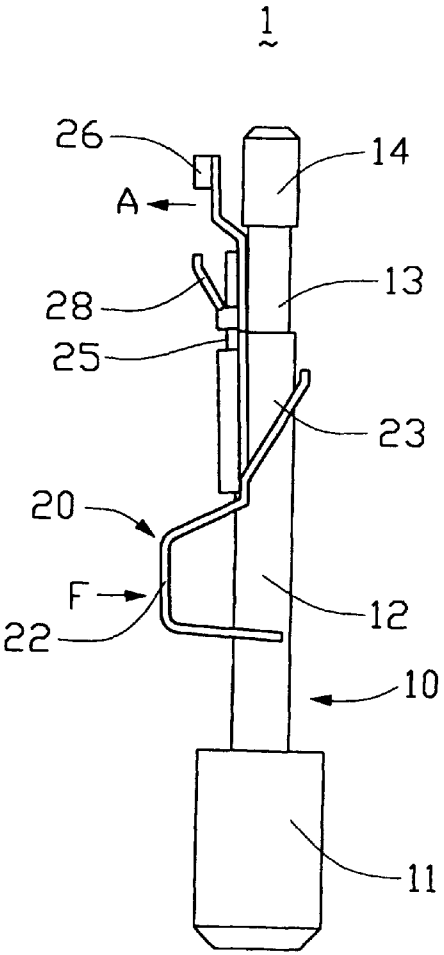
FIGS. 4A and 4B are top views of a first locking member of the locking means shown in FIG. 1 sequentially illustrating two states of the first locking member.
Figure 4A:
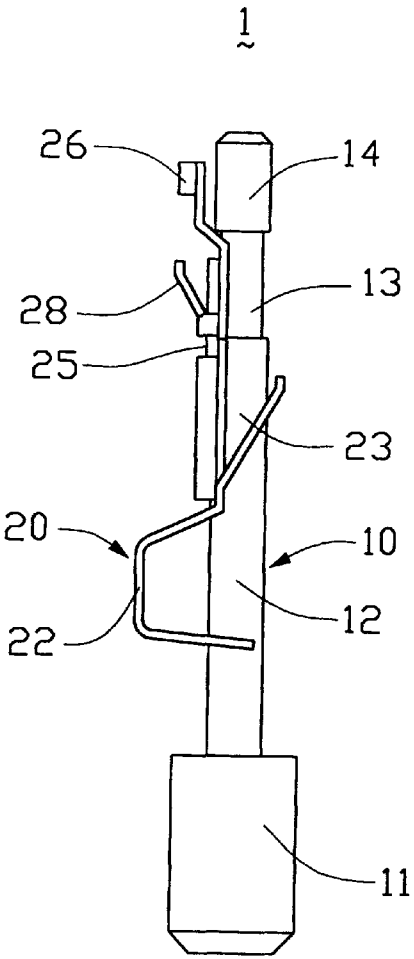
Figure 5:
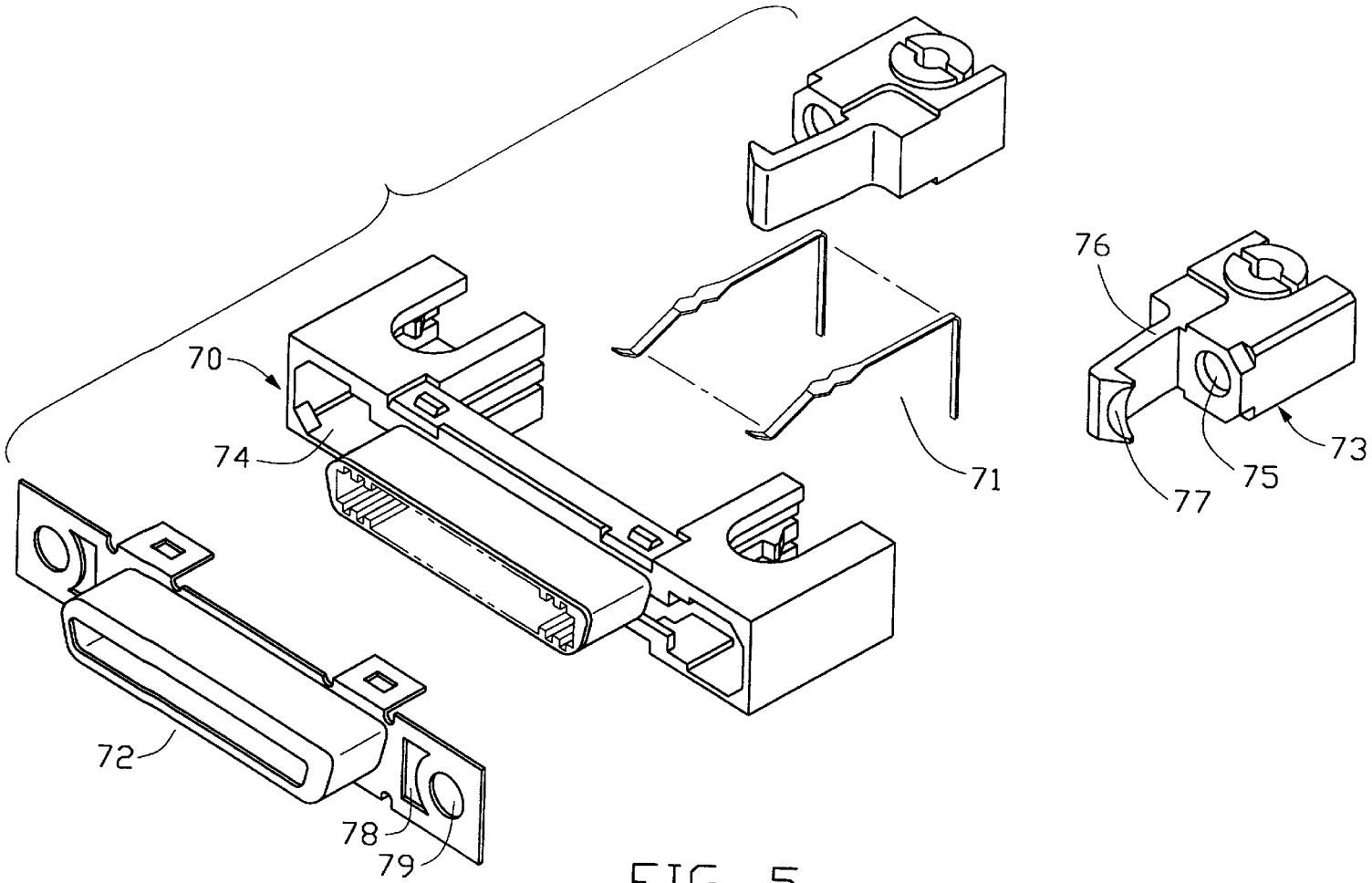
FIG. 5 (PRIOR ART)
FIG. 5 is an exploded view of a pair of conventional locking means and an electrical connector.

Also referring to FIGS. 4A and 4B, when the first connector is mating to the second connector, a force F is exerted on the press portion 22 of each latch 20 to rotate the latch 20 around the top corner 341 of the block 34 in a direction indicated by arrow A which will be referred to as A direction hereinafter. As a result, the head 26 of the latch 20 is biased to move away from the threaded portion 14 of the bolt 10. The first connector and the latches 20 move further toward the second connector and the second locking members 5 but the bolts 10 remain unmoved because they are stopped by the second locking members 5. When the first connector is fully mated with the second connector, the force F is removed and the latches 20 is biased in an opposite direction to the A direction by the first and second spring arms 23, 28. As a result, the heads 26 is biased to move toward the expanded portions 52 of the second locking members 5. The opening 27 of each latch 20 accommodates a corresponding expanded portion 52 of each second locking member 5 and the head 26 abuts against the recessed portion 53 with an edge 261 thereof bearing against a third shoulder 54 of the expanded portion 52, thereby engaging the latch 20 and the second locking member 5 together. Finally, the threaded portion 14 of each bolt 10 is threaded into a corresponding inner-threaded hole of each second locking member 5 and the first shoulder 15 bears against the station 37 and the block 34, thereby engaging the bolt 10 and the second locking member 5 together.

Although both the bolt 10 and the latch 20 of the first connector are described in the above paragraph to simultaneously engage a corresponding portion of the second connector, which is a prefer embodiment of the present invention, it should be noticed that the bolt 10 and the latch 20 may also selectively engage a corresponding portion of the second connector. That is to say, in a first alternative embodiment, the second connector may only comprises a pair of expanded portions that are engageably received in corresponding openings 27 of the latches 20, respectively, thereby preventing disengagement of the first connector from the second connector. In a second alternate embodiment, the second connector may only comprises a pair of inner-threaded holes threadedly engaging with corresponding threaded portions 14 of the bolts 10, respectively, thereby preventing disengagement of the first connector from the second connector. The two alternative embodiments should also be protected.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A locking device for joining first and second mating electrical connectors together, comprising:

a pair of first locking members adapted to be movably received in the first connector, each first locking member comprising a bolt and a latch positioned around the bolt; and a pair of second locking members adapted to be retained in the second connector;

wherein both the bolt and the latch of each first locking member are engageable with a corresponding one of the pair of second locking members;

wherein the bolt of each first locking member comprises a threaded portion, and wherein the second locking member defines an inner-threaded hole engageable with the threaded portion;

wherein the latch of each first locking member comprises a main portion defining an opening in a head thereof and a press portion manually operable to flex, and wherein the second locking member comprises an expanded portion at a distal end thereof, the opening of the latch receiving therein the expanded portion of the second locking member thereby engaging the latch and the second locking member together;

wherein the main portion of each latch comprises at least one spring aim and the head of the latch is biased by the at least one spring arm to engage the expanded portion of the second locking member;

wherein the main portion of the latch of each first locking member defines a slot in a generally middle portion thereof.

2. An electrical connector assembly comprising:

a first electrical connector comprising a housing;

a second electrical connector;

a pair of first locking members movably received in the housing, each first locking member comprising a bolt and a latch positioned around the bolt; and a pair of second locking members retained in the second connector;

wherein both the bolt and the latch of each first locking member are engageable with a corresponding one of the pair of second locking members, thereby joining the first and second connectors together;

wherein the bolt of each first locking member comprises a threaded portion, and wherein the second locking member defines an inner-threaded hole engageable with the threaded portion;

wherein the latch of each first locking member comprises a main portion defining an opening in a head thereof and a press portion manually operable to flex, and wherein the second locking member comprises an expanded portion at a distal end thereof, the opening of the latch receiving therein the expanded portion of the second locking member, thereby engaging the latch and the second locking member together;

wherein the main portion of each latch defines a slot engageable with the housing, thereby functioning as a pivot point about which the latch rotates;

wherein the main portion of each latch comprises at least one spring arm and the head of the latch is biased by the at least one spring arm to engage the expanded portion of the second locking member.

* * * * *

UNITED STATES PATENT AND TRADEMARK OFFICE

CERTIFICATE OF CORRECTION

PATENT NO. : 6,241,548 B1 
DATED : July 16, 2002
INVENTOR(S) : Herbert L. Berman and Jeffrey N. Roe It is certified that error appears in the above-identified patent and that said Letters Patent is hereby corrected as shown below:

Title page,
Item [*], Notice, please replace “2 days” with -- 21 days --.

Signed and Sealed this

Nineteenth Day of November, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,241,548 B1
DATED : June 5, 2001
INVENTOR(S) : Peter Kuo

It is certified that error appears in the above-identified patent and that said Letters Patent is hereby corrected as shown below:

This certificate supersedes certificate of correction issued November 19, 2002, the number was erroneously mentioned and should be vacated since no certificate of corrections was granted.

Signed and Sealed this

Fourteenth Day of January, 2003

JAMES E. ROGAN
*Director of the United States Patent and Trademark Office*